US007204003B2

(12) United States Patent
Davis et al.

(10) Patent No.: US 7,204,003 B2
(45) Date of Patent: Apr. 17, 2007

(54) BURIAL BELL AND TRAY

(75) Inventors: Gerald H. Davis, Fountain City, IN (US); Gary L. Cox, Richmond, IN (US); Chad L. Eversole, Richmond, IN (US)

(73) Assignee: Vandor Corporation, Richmond, IN (US)

( * ) Notice: Subject to any disclaimer, the term of this patent is extended or adjusted under 35 U.S.C. 154(b) by 227 days.

(21) Appl. No.: 10/897,579

(22) Filed: Jul. 23, 2004

(65) Prior Publication Data

US 2005/0060853 A1 Mar. 24, 2005

Related U.S. Application Data

(60) Provisional application No. 60/489,552, filed on Jul. 23, 2003, provisional application No. 60/489,554, filed on Jul. 23, 2003.

(51) Int. Cl.
*A61G 17/00* (2006.01)

(52) U.S. Cl. ..... 27/2; 27/19; 27/35

(58) Field of Classification Search ..... 27/2, 27/35, 19, 14, 4; D99/10
See application file for complete search history.

(56) References Cited

U.S. PATENT DOCUMENTS 2,192,686 A 3/1940 Hummel
2,882,584 A * 4/1959 Kidd ..... 27/11
3,133,334 A 5/1964 Johnsen
3,208,188 A 9/1965 Fulton et al.
3,270,943 A 9/1966 Polenghi
3,488,818 A * 1/1970 Orr ..... 27/2
3,512,696 A 5/1970 Ebert
3,574,906 A 4/1971 Rittenhouse
3,613,189 A 10/1971 Kirby
3,654,676 A 4/1972 McHugh
3,782,619 A * 1/1974 Dittbenner ..... 206/527
3,810,282 A 5/1974 Doggett
3,868,799 A 3/1975 Hayward
3,879,818 A * 4/1975 Rowland ..... 27/7
3,964,140 A * 6/1976 Gauchard ..... 27/2
4,063,337 A 12/1977 Havey, III
4,120,444 A 10/1978 Gray
4,135,279 A * 1/1979 Covington ..... 27/4
4,139,929 A 2/1979 Angermann
4,151,630 A * 5/1979 Havey ..... 27/2
4,154,031 A 5/1979 Williamson, Jr.
4,156,956 A 6/1979 Partridge et al.
4,170,054 A 10/1979 Ruffner et al.
4,176,431 A * 12/1979 Havey, III ..... 27/2

(Continued)

*Primary Examiner*—William L. Miller
(74) *Attorney, Agent, or Firm*—Maginot, Moore & Beck

(57) ABSTRACT

A rental casket system includes a casket with a recessed side panel for ease of viewing. The casket includes a removable end piece which is one embodiment is located within grooves formed in the side panels of the casket. The grooves widen near the upper portion of the side panels and are partially covered by a top panel. The rental casket system includes a tray assembly that may be used as part of a cremation casket. The tray has short side walls and may include an inner assembly that prevents contact with a deceased when handholds in the tray assembly are used to move the tray assembly. The tray and a lid form a burial bell assembly that may be sealed for burial. The tray assembly may include side walls that are movably attached to end walls. Lid segments are provided with the tray so that the tray may also be used as an identification tray.

25 Claims, 11 Drawing Sheets

U.S. PATENT DOCUMENTS 4,177,543 A 12/1979 Angermann
4,215,627 A 8/1980 Garriss
4,249,289 A 2/1981 Work
4,265,006 A * 5/1981 Angermann ..... 27/14
4,288,952 A 9/1981 Work
4,315,353 A 2/1982 Sorensen
4,337,556 A 7/1982 Winburn et al.
4,372,018 A * 2/1983 Miller et al. ..... 27/35
4,524,902 A 6/1985 Mortimer
4,730,370 A 3/1988 Elder
4,773,134 A 9/1988 Kay
4,788,757 A 12/1988 Bethune et al.
4,869,424 A 9/1989 Wood
4,944,076 A 7/1990 Kay et al.
4,949,439 A * 8/1990 Semon ..... 27/19
4,951,367 A * 8/1990 Wolfe ..... 27/19
4,967,455 A 11/1990 Elder
5,092,020 A * 3/1992 MaGuire ..... 27/19
5,140,728 A 8/1992 Chandler et al.
5,307,545 A 5/1994 Stoltz
5,353,484 A 10/1994 Woedl et al.
5,444,900 A * 8/1995 Shawhan et al. ..... 27/19
5,481,785 A 1/1996 Minton et al.
5,548,880 A * 8/1996 Harb ..... 27/2
5,586,679 A 12/1996 Thomas
5,615,464 A * 4/1997 Rojdev ..... 27/19
5,623,752 A 4/1997 Gillard et al.
5,659,932 A 8/1997 Wright
5,775,061 A * 7/1998 Enneking et al. ..... 53/445
5,815,898 A 10/1998 Jenkins
5,915,680 A 6/1999 Umemura et al.
5,956,825 A 9/1999 McCoy et al.
5,960,978 A 10/1999 Jenkins
6,015,084 A 1/2000 Mathieu et al.
6,145,175 A 11/2000 Enneking et al.
6,154,937 A 12/2000 Enneking et al.
6,269,526 B1 8/2001 Bischoff et al.
6,317,943 B1 11/2001 Wood
6,330,968 B1 12/2001 Peleman
6,385,824 B1 5/2002 Schwartz
6,625,852 B1 9/2003 Hanson
6,629,321 B1 10/2003 Hunt et al.
6,684,467 B1 2/2004 Walker
2001/0049868 A1 12/2001 Tambussi
2002/0023325 A1 2/2002 Fant et al.
2002/0053120 A1 5/2002 Cox et al.
2002/0166217 A1 11/2002 Lew
2004/0031133 A1 2/2004 Pace et al.
2004/0036192 A1 2/2004 Yang

* cited by examiner

BURIAL BELL AND TRAY

CROSS-REFERENCE TO RELATED APPLICATIONS

This application claims the benefit of U.S. provisional application No. 60/489,552, filed Jul. 23, 2003, and U.S. provisional application No. 60/489,554, also filed Jul. 23, 2003, both of which are hereby incorporated in full by reference.

Cross-reference is also made to the following U.S. patent applications, each having a filing date of Jul. 23, 2004, and filed under the following titles and Express Mail labels: LIGHTWEIGHT VIEWING CASKET, filed under Express Mail label number EV 390950384 US; LIGHTWEIGHT VIEWING CASKET WITH HANDLES, filed under Express Mail label number EV 390950398 US; MORTISE AND TENON CASKET, filed under Express Mail label number EV 390950407 US; MORTISE AND TENON CASKET WITH PINS, filed under Express Mail label number EV 390950441 US; MORTISE AND TENON CASKET WITH SHELF AND BRACKET ASSEMBLY, filed under Express Mail label number EV 505539263 US; RENTAL CASKET WITH REMOVABLE END PANEL, filed under Express Mail label number EV 390950375 US; and MULTIPURPOSE FUNEREAL TRAY, filed under express Mail Label number EV 505539277 US, each of which are hereby incorporated in full by reference.

FIELD OF THE INVENTION

The present invention relates generally to burial and cremation containers.

BACKGROUND OF THE INVENTION

Cremation containers are containers in which a deceased may be placed prior to cremation. Cremation containers range from elaborate hardwood caskets to simple corrugated paper cartons. Some cremation containers are intended to be consumed during cremation, and others are not.

Cremation is often considered to be a low cost funerary option, as it eliminates the need for interment space. Extremely low costs may be achieved by employing a corrugated paper cremation container, which is a fraction of the cost of hardwood or metal caskets. Even if cost is not a major consideration, corrugated paper caskets are a popular choice for cremation. Paper caskets are preferred, in part, because they are completely consumed during the cremation process so there are no metal components remaining in the ash after the cremation.

Many corrugated paper caskets have design elements that approximate decorative wood or steel caskets. Many people find such paper caskets to be suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, the least expensive option is a simple rectangular corrugated paper container and associated simple rectangular lid that fits over the container in a manner similar to that of a common shoe box. The deceased fits within the container and then the rectangular lid is fitted over the container to close off the casket.

One drawback associated with the simple rectangular paper container is the perceived lack of dignity that the container provides. While the simple rectangular paper container may not be intended for elaborate funerary proceedings, there is still a need for identification of a deceased by the next-of-kin, and often a need for the closest relatives to pay last respects. Such viewings are often emotional in nature, and it desirable to provide the appearance of some dignity, even if expensive containers are not an option.

There is a need therefore, for a casket or cremation container that retains much or all of the economy of the simple rectangular container design while providing additional aesthetic display of the deceased for identification and viewing purposes.

Another problem with prior art corrugated box container caskets relates to handles for carrying the container. Typically, a handle is formed as a cut-out in the corrugated container. However, a drawback associated with this type of handle is that one lifting the casket could contact the remains located within the casket. Therefore, there is also a need for a handle that may be used with corrugated container and other relatively inexpensive caskets that allows the casket to be easily and comfortably lifted while shielding the casket bearer from the remains of the deceased.

Yet another problem with relatively inexpensive caskets and cremation containers lies in the manufacturing method for such containers. In particular, such containers must be constructed of materials that are sufficiently strong to bear the weight of the deceased. To this end, the method of joining the different panels of the container must not only be inexpensive, but must be reliable, such that the joints of the container can dependably bear the weight of the deceased in the casket without compromising the structural integrity of the casket. At the same time, the material used to connect the joints should be easily hidden from view.

Although the paperboard caskets mentioned above are one extremely inexpensive option for cremation containers, it is often helpful to provide a number of relatively inexpensive casket options to the family of the deceased. These casket options typically cover several price ranges and include various features. Such caskets may be made of a number of different materials, including wood, metal, and paper materials, as well as combinations of the foregoing. Traditional wood-based caskets are preferred by many and continue to experience widespread use because they combine a high level of strength with desirable aesthetic qualities. Typical wood caskets, however, can be extremely expensive. Even caskets that use less expensive types of wood and simpler designs have considerable expense.

The main cost elements in a wood casket, as with virtually any manufactured product, includes the raw materials and the labor associated with assembly of the casket. Less expensive caskets have been made of low grade steel, but such caskets do not represent a significant cost savings over the low-end wood caskets. As mentioned above, paperboard caskets have been used for cremation containers, but paperboard caskets do not convey the quality and warmth of wood.

Thus, there is a need for a casket having reduced cost as compared to traditional casket manufactures, particularly for a casket that conveys the natural beauty and warmth of wood.

Another option for those desiring to reduce the costs associated with a funeral, while still maintaining a suitably decorous viewing environment includes rental of a presentation casket. In such options, a cardboard cremation casket is still used for the actual cremation. However, viewing of the deceased is done in a more expensive casket. For example, one could rent an expensive cremation casket, or even a burial casket. In either event, the rental is a fraction of the cost of purchasing the casket yet the deceased is still presented in a suitable environment.

There are certain problems that can arise when using a rental system. For example, in order to ease the insertion and removal of the deceased from the rental casket, certain prior art caskets fit one end of the casket with a hinged door. Once the door is opened, the deceased may be moved in or out. Frequently, this process is eased by the placement of rollers within the casket. When using such rental caskets while transporting the deceased from one location to another, it may be necessary to maneuver over inclines such as stairs. This may result in the deceased moving within the casket. In the event the deceased contacts the hinged door, the door may become unlatched, allowing the deceased to unintentionally fall out of the casket.

Thus, there is a need for a rental casket system that allows a deceased to be easily placed in and removed from the casket, while reducing the potential for unintentional opening of a portion of the casket.

As discussed above, the cardboard cremation caskets are typically considered to be an economical approach to cremation. However, a significant cost of such inexpensive cremation caskets is the shipping cost. Even though the caskets are fairly light, they are very bulky when assembled. Thus, to replenish used inventory, an establishment typically pays a shipping premium due to the size of the cremation caskets. Additionally, storage of the cremation caskets at the funeral establishment requires a large area. Alternatively, the establishment is required to perform an unduly complicated assembly of the cremation caskets.

Thus, there is a need for a cremation casket that presents a reduced profile for shipping. It would be beneficial for a cremation casket to be easily and securely assembled when shipped in an unassembled or partially assembled configuration.

Notwithstanding the limitations of certain of the prior art rental caskets, many establishments have made a significant capital investment in the rental caskets. Accordingly, it would be beneficial if a replacement cremation casket addressed any of the problems of known cremation caskets while being compatible with known rental caskets.

SUMMARY OF THE INVENTION

The inventions described herein have several aspects, each of which individually addresses one or more of the problems of the prior art discussed above, and/or other problems or shortcomings not specifically mentioned, but which will become readily apparent to those of ordinary skill in the art by reference to the following detailed description and accompanying drawings.

A first embodiment of the invention is a rental casket system with a tray. The system includes a lid assembly for use with the tray. The height of the side walls of the lid assembly is shorter than the height of the side walls of the tray. The tray thus presents a low profile, allowing for reduced shipping costs as compared to trays that have higher side walls. Moreover, the tray may be used with caskets having recessed side panels which allow viewing of a deceased lying upon the tray.

To this end, another embodiment of the rental casket system includes a presentation casket with a recessed side panel. The recessed side panel allows for viewing of a deceased without the need to include a separate lifting system, to lift the deceased out of the casket. The casket may include a removable end piece that moves within grooves provided in the casket side panels. The top of the casket partially obstructs the grooves. Thus, the removable end piece may be placed in a first position wherein the end piece cannot be lifted out of the grooves and a second position wherein the removable end piece may be lifted out of the grooves.

Still another embodiment of the invention fulfills one or more of the above needs, as well as others, by providing a presentation casket formed with a plurality of panels having a mortise and tenon interlocking parts. The mortise and tenon assembly allows for ease of manufacture, and provides a unique, aesthetically attractive wood-based alternative to traditional caskets. To this end, one aspect of the invention is a presentation casket that includes a plurality of panels assembled into a container. Each panel has two sides and a number of edges. At least a first panel includes a plurality of tabs extending from at least a first edge thereof. At least a second panel includes a plurality of holes, and wherein the plurality of tabs extending through the plurality of holes.

Another embodiment of the invention includes a bracket assembly that may be used to provide a display shelf for an inexpensive presentation casket. The bracket assembly may be mounted on the side panel of the casket and provides a shelf for displaying mementos, flowers or other sentimental displays. The bracket assembly may also be used to hold the casket lid, thereby providing a traditional hinged appearance to the casket even though the lid of the casket is not hinged.

In yet another embodiment, a lid assembly for use with a tray may include a lower lid and an upper lid. Removal of the upper lid allows the tray and lid assembly to be used as an inexpensive alternative to a rental casket or for purposes of identification of a deceased lying on the tray. Thus, according to another aspect of the invention, a plurality of slip covers are provided that fit over the bedding of the tray. Accordingly, a slip cover of a particular color or pattern may be selected. A matching modesty skirt may also be selected and hung from the lower lid.

In one embodiment, a tray assembly includes a pillow and bedding that is designed to allow nesting of tray assemblies for shipping. Accordingly, a cavity is provided at one end of the bedding into which a pillow from a second tray assembly can be nested.

In yet another embodiment of the invention, a tray assembly includes an inner assembly and an outer assembly. Handholds are provided in the outer assembly to facilitate moving the tray assembly. One such handhold may be located at an end of the tray to facilitate removal of the tray assembly from a rental casket. The rental casket may be provided with a notch to allow easier access to the handhold. An inner assembly includes a leak resistant barrier placed within an inner shell. The inner shell extends upwardly and outwardly and over the handhold. Accordingly, the inner shell prevents contact with a deceased on the tray when the tray assembly is grasped through the handhold.

In still another embodiment of the invention, a tray has a height substantially less than the height of a lid assembly. The lid assembly may be made of a material that provides sufficient strength such that lid may be used as a burial bell. Such material may suitably be styrene. The tray may also be made of styrene.

The above described features and advantages, as well as others, will become more readily apparent to those of ordinary skill in the art by reference to the following detailed description and accompanying drawings.

DETAILED DESCRIPTION

Figure 1:
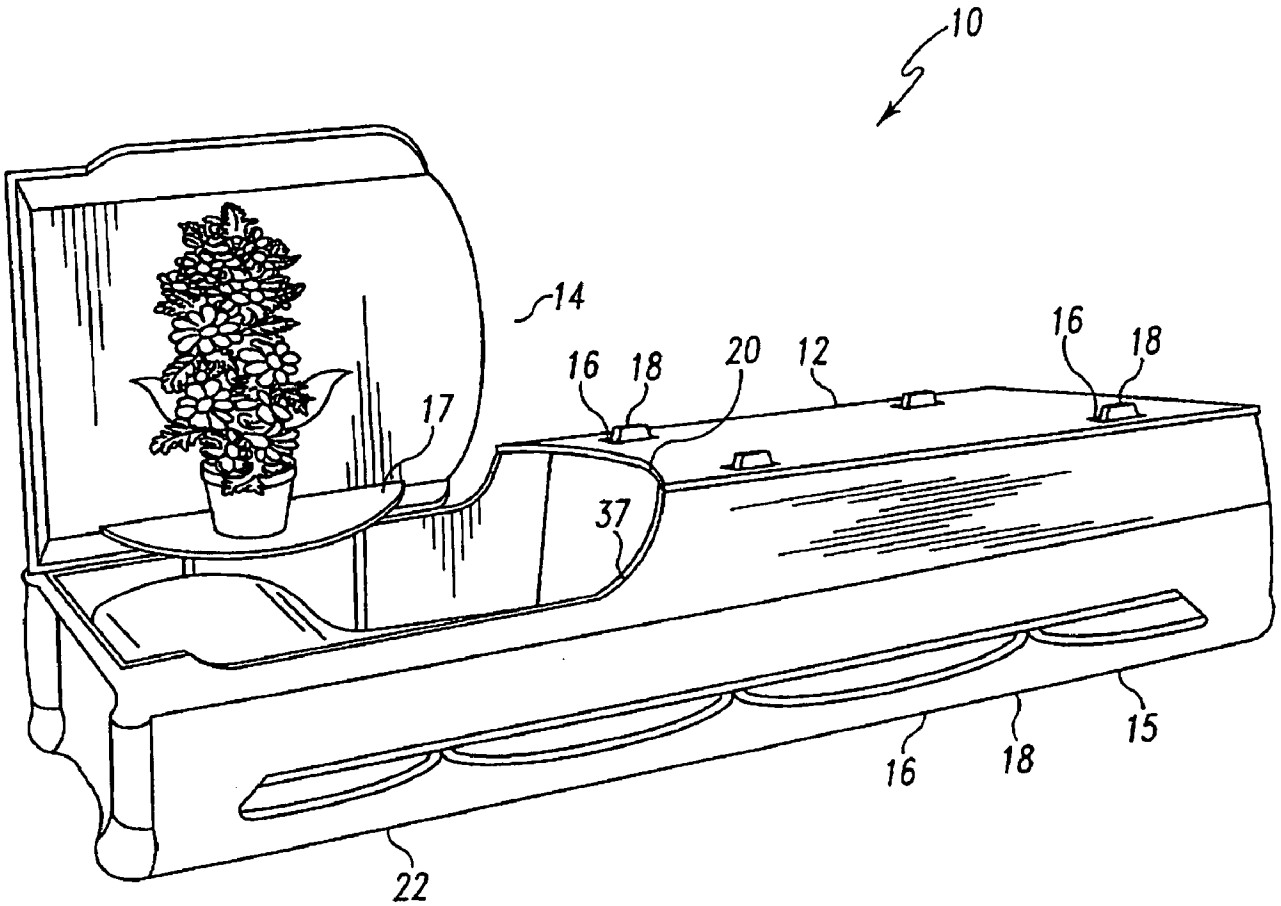
FIG. 1 shows a perspective view of a rental casket system that incorporates several inventive aspects described herein.

For the purposes of promoting an understanding of the principles of the invention, reference will now be made to the embodiments illustrated in the drawings and described in the following written description. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

FIG. 1 shows a rental casket system 10 that incorporates features of the present invention. The rental casket system 10 includes presentation casket 12, lid 14 and handle 15. The lid 14 is set into a viewing position using a shelf and bracket assembly 17. A suitable shelf and bracket assembly is described in the above related U.S. patent application Ser. No. 10/897,970, filed on Jul. 23, 2004 under Express Mail label number EV 390950384 US and entitled Lightweight Viewing Casket, the teachings of which are herein incorporated by reference. The presentation casket 12 in this embodiment is fabricated from chipboard, with a decorative vinyl skin vacuum adhered. The presentation casket 12 is constructed with mortise joints using mortises 16 and tenons 18. A modesty skirt 20 and a pillow 22 are also shown in FIG. 1.

Figure 4:
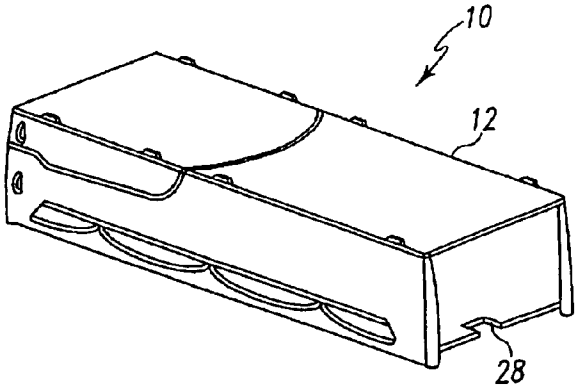
FIG. 4 shows a perspective view of the casket of the rental casket system of FIG. 1 with the tray removed.
Figure 2:
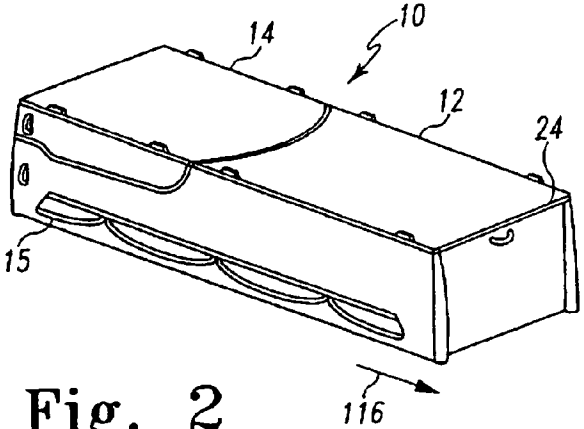
FIG. 2 shows a perspective view of the rental casket system of FIG. 1 with the lid closed.
Figure 3:
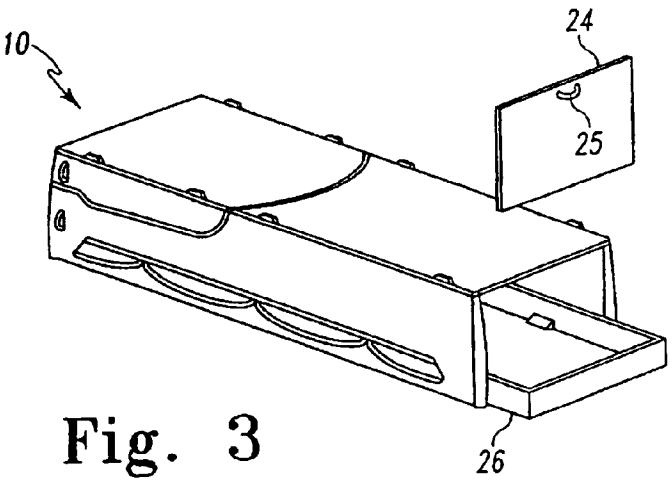
FIG. 3 shows a perspective view of the rental casket system of FIG. 1 with the removable end piece removed and the tray partially withdrawn.

FIG. 2 shows the presentation casket 12 with the lid 14 closed. The casket 12 includes two side panels 36 and 38 and a top panel 30. Each of the side panels 36 and 38 include a recessed portion 37. A removable end piece 24 functions as a movable vertical wall in this embodiment and is shown in FIG. 2. A handle 25 is provided on the removable end piece 24. FIG. 3 shows the removable end piece 24 removed and a tray 26 of the rental casket system 10 partially withdrawn from the presentation casket 12. With the removable end piece 24 and the tray 26 removed, notch 28 of the presentation casket 12 is visible as shown in FIG. 4.

Figure 5:
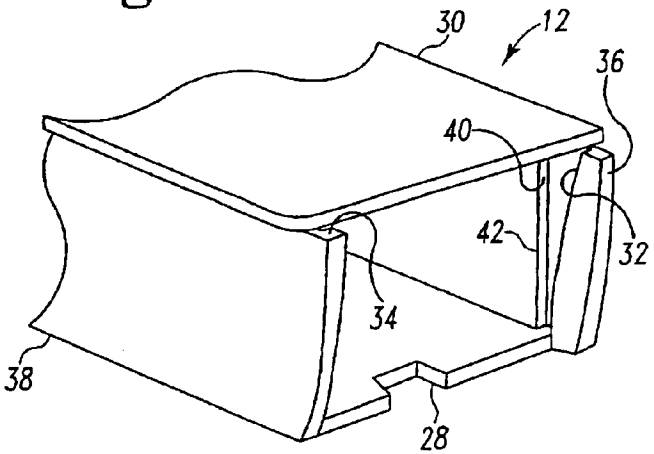
FIG. 5 shows a partial perspective view of the end portion of the casket of FIG. 4 from which the removable end piece has been removed.

Referring now to FIG. 5, the top panel 30 of the presentation casket 12 extends partially over the grooves 32 and 34 formed in the side panels 36 and 38, respectively. A magnet 40 is located on the rim 42 of the groove 32. The grooves 32 and 34 are wider at the upper portion of the side panels 36 and 38. The magnet 40 attracts a piece of metal (not shown) mounted on the inner surface of the removable end piece 24, maintaining the removable end piece 24 firmly against the rim 42. It will be appreciated that the magnet and metal may be placed in a number of alternative locations while providing the function of keeping the removable end piece 24 firmly against the rim 42. Moreover, it may be desired to provide a spring as the biasing means. Alternatively, other fastening systems may be used, including, but not limited to, Velcro.

Figure 6:
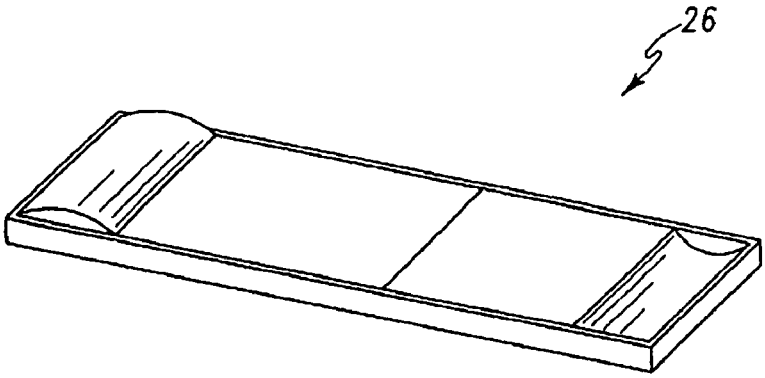
FIG. 6 shows a perspective view of the tray assembly of the rental casket system of FIG. 1 that incorporates several inventive aspects.
Figure 7:
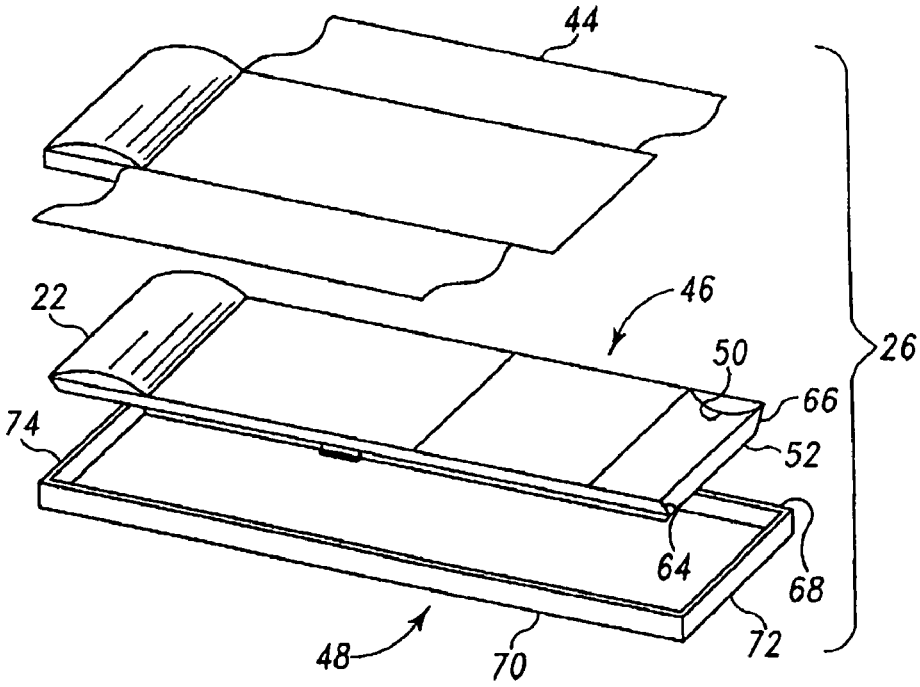
FIG. 7 shows an exploded perspective view of the tray assembly of FIG. 6.
Figure 8:
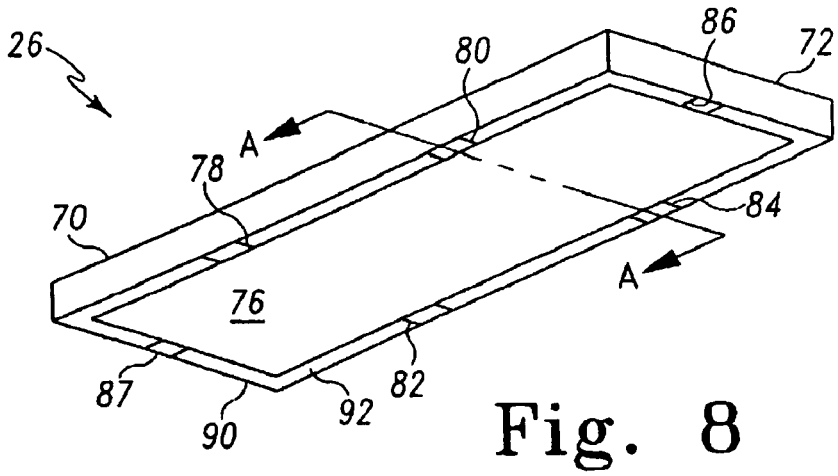
FIG. 8 shows a bottom perspective view of the tray assembly of FIG. 6.
Figure 9:
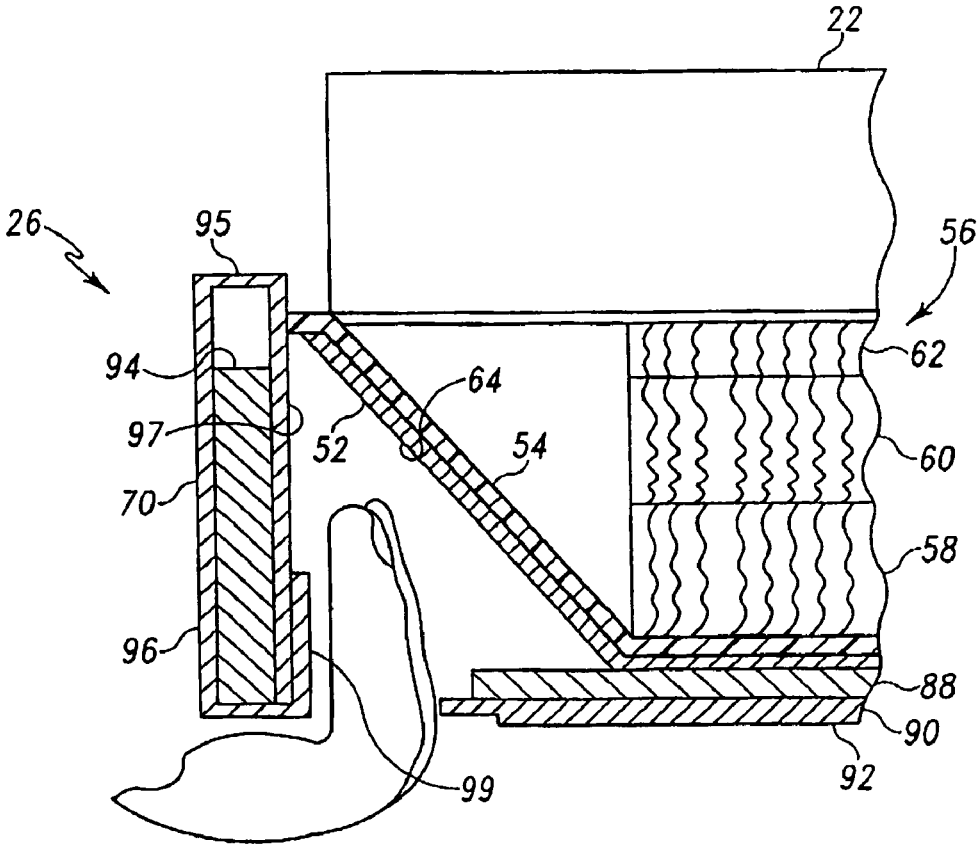
FIG. 9 shows a partial cutaway view of a tray assembly taken along line A—A of FIG. 8.

The tray 26 is shown in FIG. 6. As shown in FIG. 7, the tray 26 includes a slip cover 44, an inner assembly 46 and an outer assembly 48. The inner assembly 46 includes the pillow 22, a cavity 50 and an inner shell 52. As shown in FIG. 9, which is a partial cross-sectional view of the tray 26 taken across the line A—A of FIG. 8, the inner assembly 46 further includes a liner 54 and bedding 56. The mattress or bedding 56 is made of three layers of spun polyethylene. The layers 58 and 60 are one inch thick spun polyethylene and the layer 62 is one-half inch thick. The pillow 22 is also made of one inch thick spun polyethylene material. To construct the pillow 22, a center core of spun polyethylene is formed and then additional spun polypropylene is rolled around the core to the desired thickness. The outer layer of spun polypropylene may be affixed to an under lying layer if desired, such as by using a Swiftach® fastening system commercially available from Avery Dennison of Brea, Calif. The bedding 56 in this embodiment is stacked to about the same height as the sidewalls 64 and 66 of the inner shell 52.

The liner 54 is constructed of a leak resistant material, such as a polyethylene sheet. A flat sheet may be used since the inner shell 52 provides support and forms a depression suitable for containing short term leakage. The potential for leakage is further minimized by the bedding 56 which will absorb some fluids. The inner shell 52 in this embodiment is made from 32 ECT single wall kraft paper. When assembled, the side walls 64 and 66 are simply folded upward from the bottom portion of the inner shell 52 and the entire inner assembly 46 is placed within the outer assembly 48. The outer assembly 48 provides most of the structural support.

Figure 10:
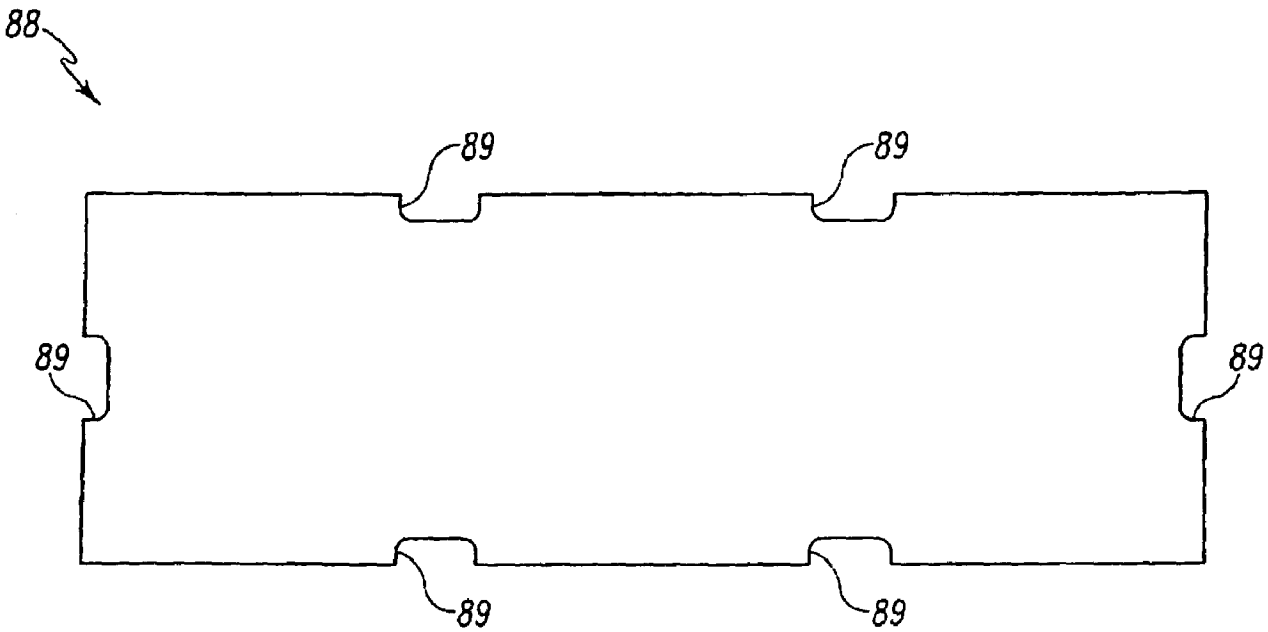
FIG. 10 shows a plan view of a layer of the tray assembly of FIG. 6.

The outer assembly 48 includes the side walls 68 and 70 and the end walls 72 and 74. A bottom portion 76 of the outer assembly 48 includes handholds 78, 80, 82, 84 and 87. The bottom portion 76 includes a layer 88, a layer 90 and a layer 92. The layer 88 is made from 71 ECT double wall kraft reinforcing pad. The kraft reinforcing pad is cut into the shape shown in FIG. 10, including the cutouts 89 which are used for the handholds 78, 80, 82, 84 and 87. The layer 88 is then laminated to the layer 90. The layer 90 is made from 32 ECT single wall kaft paper and is discussed more fully below. The layer 92 is made from 0.036 inch chipboard that is simply cut in a rectangular shape that is sized to not protrude over the handholds 78, 80, 82, 84 and 87. The layer 92, which provides additional strength and reduced friction, is laminated onto the layer 90.

The side walls 68 and 70 and the end walls 72 and 74 in this embodiment are made of an inner core 94 of 0.5 inch medium density fiberboard sandwiched between a layer 96 and a layer 97 of 32 ECT single wall kraft paper. An upper surface 95, also made of 32 ECT single wall kraft paper, connects the layer 96 and a layer 97. The inner core 94 provides additional strength or stiffening. Accordingly, other materials may be used as an inner core including plastic, particle board, wood and metal.

Figure 11:
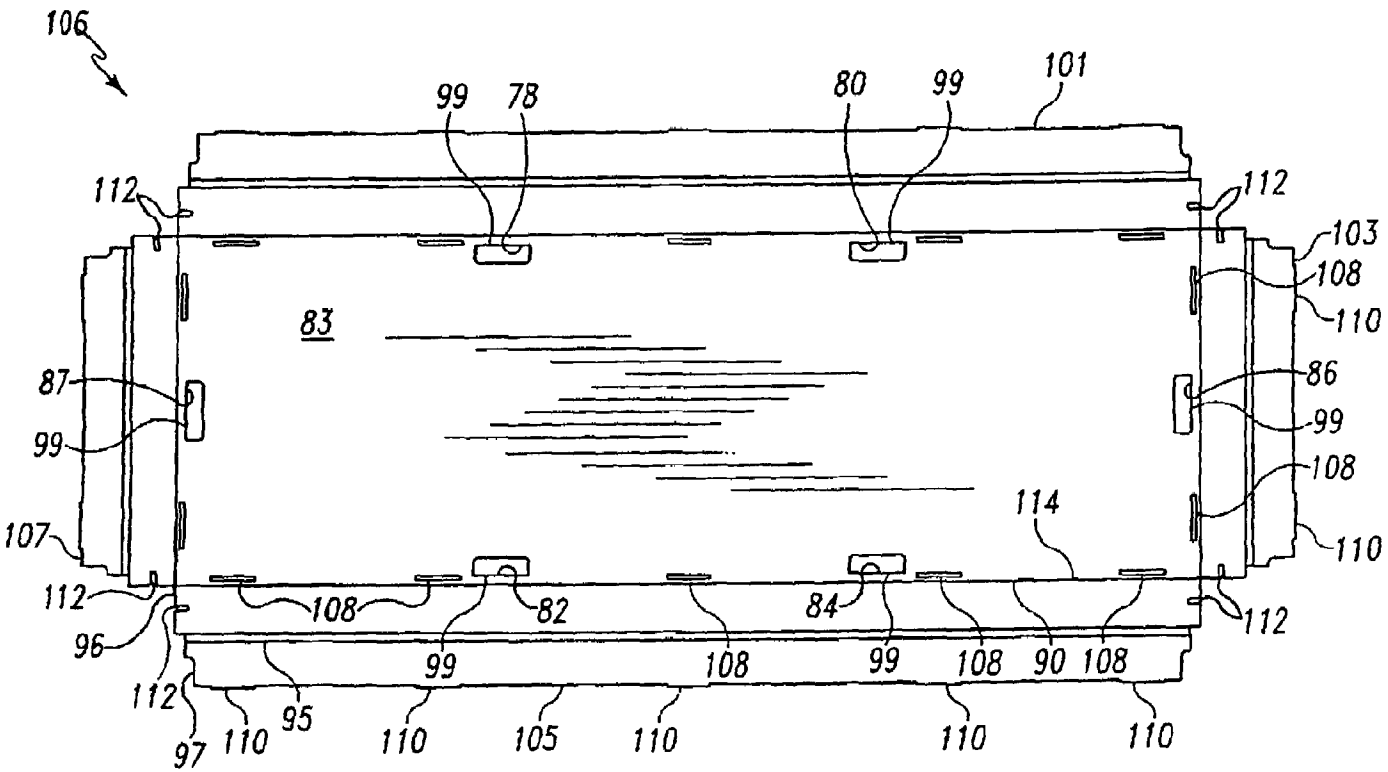
FIG. 11 shows a plan view of a scored cut-out piece of kraft paper that is used to form the outer assembly of the tray assembly of FIG. 6.

In this embodiment, the layer 92, the layer 96 and the layer 97 are formed from a single piece of kraft paper 106 that is cut into the shape shown in FIG. 11. The kraft paper 106 includes bottom portion 83 and outer portions or ears 101, 103, 105 and 107 which are used to form side wall 68, end wall 72, side wall 70 and end wall 74, respectively. The kraft paper 106 is scored for folding as indicated by the dashed lines, such as dashed line 114. The kraft paper 106 also includes cutouts 108, tabs 110 and notches 112.

To form the outer assembly 48 from the kraft paper 106, one side of the inner core 94 is adhered to the layer 96, and the upper surface 95 is bent above the upper side of the inner core 94. The layer 97 is folded over the second side of the inner core 94 and adhered to the inner core 94 to form the side wall 70. The side wall 70 is then bent along the dashed line 114 so as to be perpendicular to the bottom, and each of the tabs 110 are inserted into a corresponding cutout 108. The side wall 68 and end walls 72 and 74 are formed similarly.

Each of the side walls 68 and 70 are joined to each of the end walls 72 and 74 using a tie wrap. This construction is shown with respect to the side wall 70 and the end wall 72 in FIGS. 12A–12D. The side wall 70 includes a hole 98 in the inner core 94. Access to the hole 98 when the core is sandwiched between the layers 96 and 97 is allowed through a notch 112 in the layer 96 of kraft paper 106. Similarly, a notch 112 in the end wall 72 allows access to a hole 100 in the inner core 114 of the end wall 72.

Figure 12A:
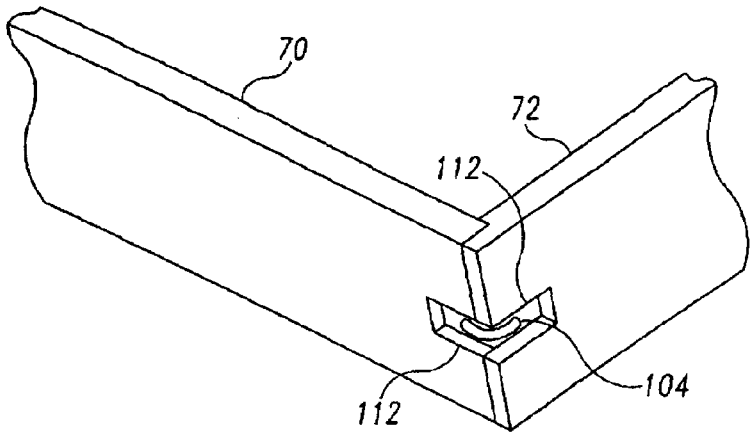
FIG. 12A shows a partial perspective view of a corner of the outer assembly of the tray assembly of FIG. 6.
Figure 12B:
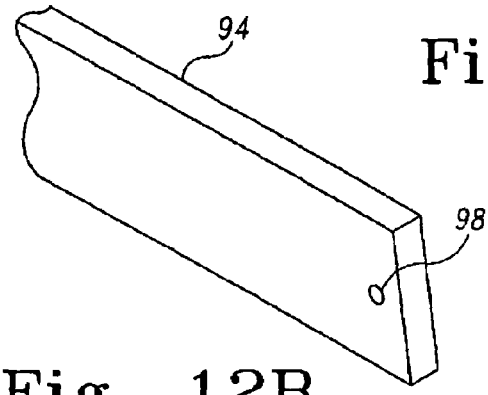
FIG. 12B shows a partial perspective view of a side wall of the outer assembly of the tray assembly of FIG. 6.
Figure 12C:
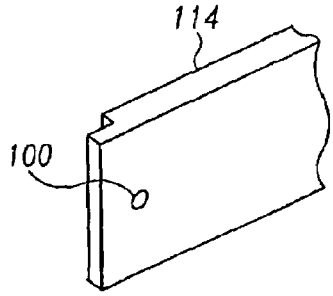
FIG. 12C shows a partial perspective view of a rabbetted end wall of the outer assembly of the tray assembly of FIG. 6.
Figure 12E:
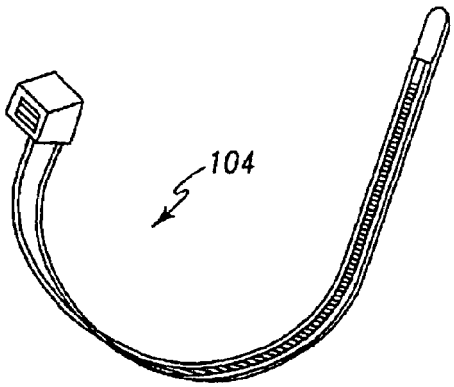
FIG. 12E shows a perspective view of a tie wrap used in the outer assembly of the tray assembly of FIG. 6.
Figure 12D:
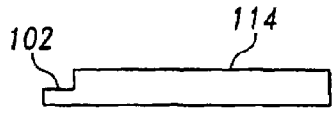
FIG. 12D shows a partial top plan view of the end wall of the outer assembly of the tray assembly of FIG. 12C.

The inner core 114 of the end wall 72 is rabbetted along the end portion 102. The kraft paper 106 is shaped to allow direct contact between an end portion of the inner core 94 and the rabbet at the end portion 102 of the inner core 114. Thus, the end wall 72 and the side wall 70 form a rabbet joint as shown in FIG. 12A. To maintain the rabbet joint of the end wall 72 and the side wall 70, a tie wrap 104 is inserted through the slots 112 and both of the holes 98 and 100, and tightened.

Use of the tie wrap 104 allows for some movement between the side wall 70 and the end wall 72 as the tray 26 is moved, while providing sufficient rigidity to allow persons carrying the tray 26 to maintain good control over the tray 26. If desired, the tie wraps may be covered by placing a piece of tape or other material over the slots 112 after the tie wrap is installed. Other fastening means may also be used. By way of example, but not of limitation, a wire wrap, cable, rope or twine may be used. The material may be any suitable material such as plastic, fiber, rubber or metal. Generally, if the tray 26 is to be used for cremation, it is desirable to use a combustible material in the construction of the tray 26. If the tray 26 will be used in a burial situation, non-combustible materials may be substituted.

The handholds 78, 80, 82, 86 and 87 are made by folding the perforated sections 99 of the kraft paper 106 to lie against the layer 97 as shown in FIG. 9.

To use the rental casket system 10, the tray 26 is prepared by selecting a slip 44 from available colors and/or patterns as desired by the person(s) making the funeral arrangements. The slip 44 is then placed over the inner assembly 46 and the slip 44 and inner assembly 46 are placed in the outer assembly 48. A deceased may then be arranged upon the tray 26. If desired, a modesty skirt 20 may be selected to match or complement the selected slip 44 and installed into the presentation casket 12.

The presentation casket 12 is opened by first pulling handle 25 away from the presentation casket 12 in the direction of arrow 116 shown in FIG. 2. This separates the removable end piece 24 from the inner rim 42 and magnet 40. The removable end piece 24 is then moved against the rim of the groove 32 opposite the rim 42. In this position, the removable end piece 24 may be lifted past the top panel 30 of the presentation casket 12. It will be appreciated that the removable end piece 24 may only be removed by moving the removable end piece 24 along two different axes. This reduces the potential for inadvertent opening of the presentation casket 12 as the presentation casket 12 is being lifted or moved along an incline.

Returning to use of the rental casket system 10, once the removable end piece 24 has been removed, the loaded tray 26 is lifted by grasping the side walls 68 and 70 through the handholds 78, 80, 82 and 84. The configuration of the side walls 64 of the inner shell 52 allow fingers to be inserted through the handholds without encountering the inner shell 52 as shown in FIG. 9. Specifically, the bottom portion of the inner shell 52 is narrower than the width of the layer 90 by a distance of about twice the width of one of the handholds 78, 80, 82 and 84. Thus, when the inner shell 52 is positioned on the outer assembly 48, the side walls 64 and 66 of the inner shell 52 are located above and spaced apart from the handholds 78, 80, 82 and 84. The construction about handholds 86 and 87 is similar.

Continuing with the use of the rental casket system 10, as the tray 26 is lifted, the layers 88 and 92 provide support to ensure the tray 26 does not fail, while the weight of the deceased is transferred to the side walls 68 and 70 through the kraft paper 106 from the layer 92 to the layer 96.

The loaded tray 26 is then slid into the presentation casket 12 and the removable end piece 24 is replaced by reversing the actions set forth above for removing the removable end piece 24. The presentation casket 12 may then be prepared for a viewing by removing the lid 14. Because side panel 38 has a reduced height at the recessed portion 37, a clear view of the deceased lying on the tray 26 is provided without the need to elevate the tray 26.

When it is desired to remove the tray 26 from the presentation casket 12, the handle 25 is pulled away from the presentation casket 12 in the direction of arrow 116 shown in FIG. 2 to separate the removable end piece 24 from the inner rim 42 and magnet 40. The removable end piece 24 is then moved against the rim of the groove 32 opposite the rim 42 and lifted past the top panel 30 of the presentation casket 12. The tray 26 is removed by grasping the handhold 86 and pulling the tray 26 out of the presentation casket 12. Easy access to the handhold 86 is provided by the notch 28.

Figure 13:
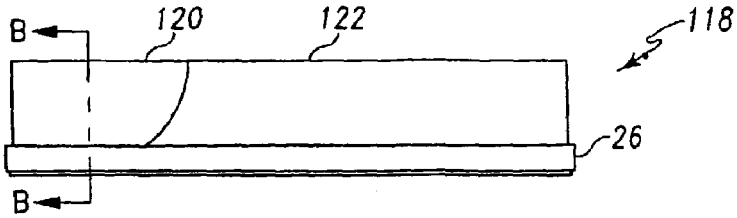
FIG. 13 shows a side plan view of the tray of the rental casket system of FIG. 1 with a lid assembly that may be used as a cremation casket.
Figure 14:
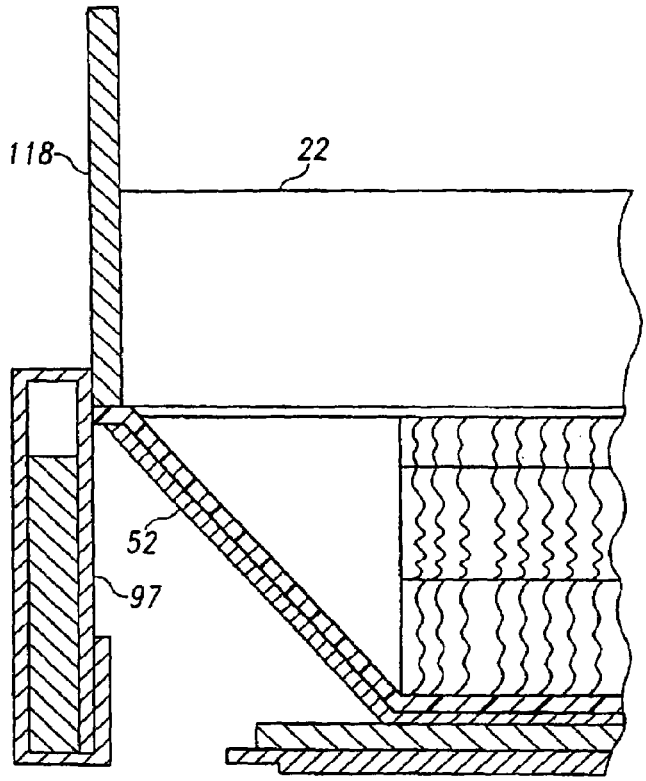
FIG. 14 shows a partial cross sectional view of the tray and lid assembly of FIG. 13 taken along line B—B of FIG. 13.

Once removed, the tray 26 may be used to transport the deceased to a cremation facility. In accordance with one aspect of the present invention, a lid may be provided for use during such transportation and cremation. Referring now to FIG. 13, tray 26 is engaged with lid assembly 118. As shown in FIG. 14, the lid assembly 118 is inserted inside of the layer 97 and rests on top of the inner shell 52. In the embodiment of FIG. 13, the lid assembly 118 includes two lid segments, an upper lid 120 and a lower lid 122.

Figure 15:
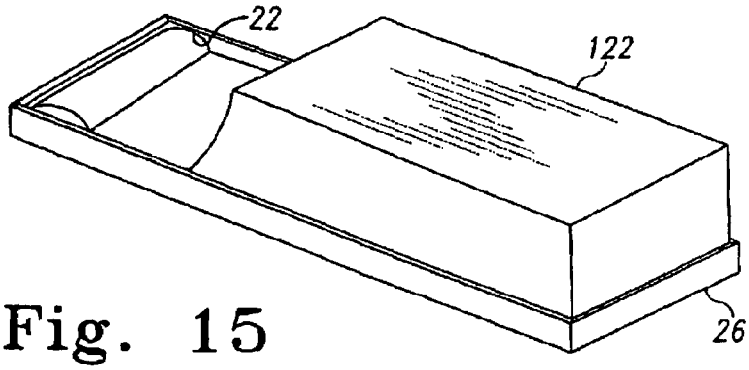
FIG. 15 shows a perspective view of the tray and lid assembly of FIG. 13 with the upper lid removed.

The lid assembly 118 enables the tray 26 to be used as an identification tray. As shown in FIG. 15, the tray 26 may be covered with the lower lid 122. This allows a viewer an unobstructed view of a deceased lying on the tray 26 because the side walls 68 and 70 of the outer assembly and the side walls 64 and 66 of the inner assembly are of a limited height. Thus, a viewer may identify a deceased on the tray 26 without the need to closely approach the tray 26. When used as an identification tray, the lower lid 122 may be fitted with a modesty skirt (not show).

Figure 16:
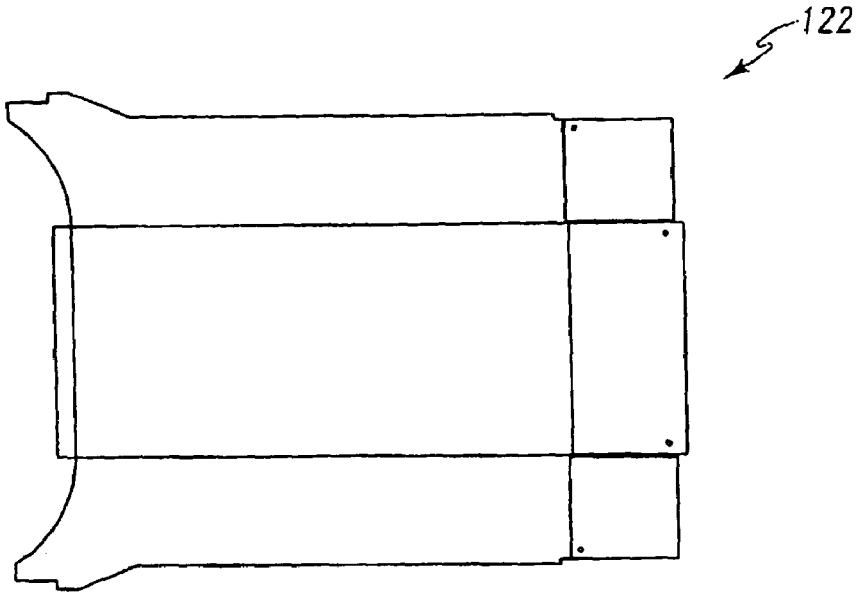
FIG. 16 shows a plan view of a scored cut-out piece of kraft paper that is used to form the lower lid of the lid assembly of FIG. 13.
Figure 17:
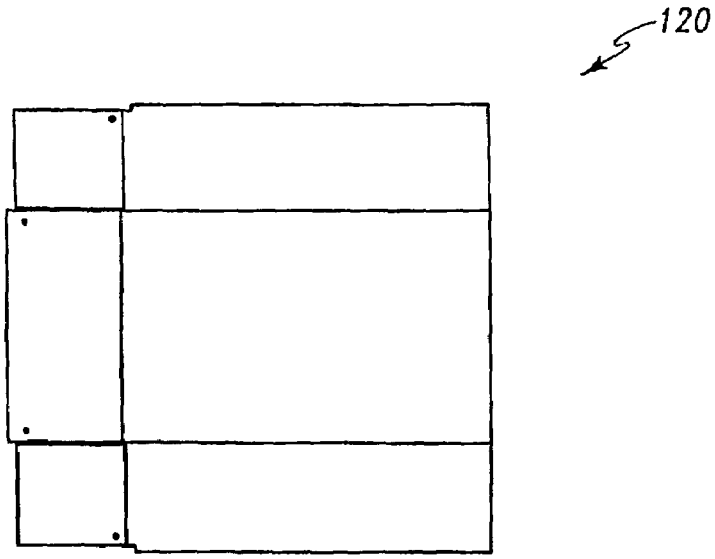
FIG. 17 shows a plan view of a scored cut-out piece of kraft paper that is used to form the upper lid of the lid assembly of FIG. 13.

The lid assembly 118 in this embodiment is made by cutting 32 ECT single wall kraft paper into the shapes shown in FIGS. 16 and 17 to make the lower lid 122 and the upper lid 120, respectively. The upper lid 120 and the lower lid 122 are formed by folding along the score lines that are indicated in FIGS. 14 and 15 as dashed lines.

Thus, the tray 26 may be used for a variety of purposes. The tray 26 can be configured for use to identify a deceased prior to cremation and/or prior to a funeral service. The tray 26 may then be used with the presentation casket 12 in a rental system, for moving a deceased into the presentation casket 12. The tray 26 may also be sized for use with other rental systems. In the event a particular rental system does not have a side of reduced height for ease of viewing, the elevating assembly of the rental system may be used to elevate the tray 26. In the event an elevation system requires additional structural support for the tray 26, a piece of plywood may be inserted under the tray 26 when placing the tray 26 into the rental casket. After viewing, the tray 26 may be used along with the lid assembly 118 as a cremation casket.

As discussed above, the tray 26 may be inexpensively manufactured using inexpensive materials. Additionally, the tray 26 may be shipped inexpensively. For example, the side walls 68 and 70 of the outer assembly are of about the same height as the bedding 56. Thus, the volume required when shipping the tray 26 does not include substantial volumes of unused air space. Additionally, the cavity 50 in the tray 12 is sized to receive a pillow 22. Accordingly, two trays 26 may be nested. That is, two trays may be stacked with the pillow of each tray in the cavity of the other tray. In one embodiment, the tray does not include a cavity. Nested stacking is still available by compressing the pillow to the bedding of the other casket.

Alternatively, the tray 26 may be shipped in a partially assembled state. By way of example, but not of limitation, the outer assembly 48 of the tray 26 may be shipped with the side walls 68 and 70 and the end walls 72 and 74 unattached to each other. Thus, when it is desired to assemble the tray 26, the outer assembly 48 may be assembled by using four tie wraps to attach the side walls 68 and 70 to each of the end walls 72 and 74.

Moreover, various elements of the rental casket system may be manufactured from alternative materials. By way of example, the tray and lid assembly may be molded from a polypropylene. In such an embodiment, the handholds could be molded such that the tray is leak resistant without the need of a leak resistant sheet. This embodiment is particularly useful when using the tray and lid assembly for burial, as the lid assembly and tray may be hermetically sealed.

Figure 20:
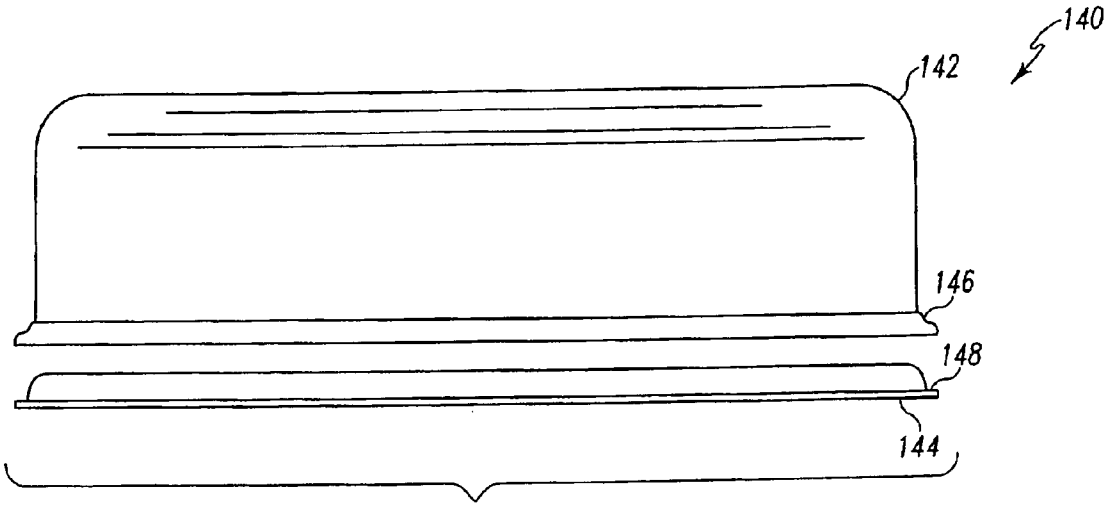
FIG. 20 shows an exploded view of a burial bell assembly in accordance with features of the present invention.
Figure 21:
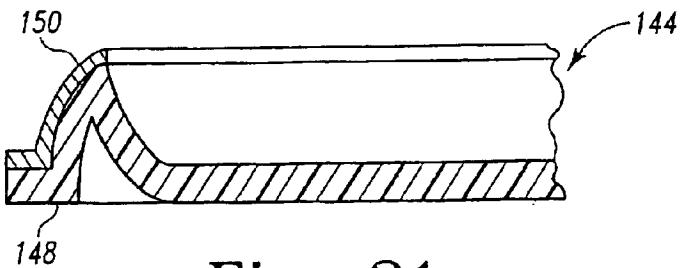
FIG. 21 shows a partial cross sectional view of the tray of the burial bell assembly of FIG. 20.

One example of a lid and tray assembly that may be sealed is shown in FIGS. 20 and 21. A burial bell assembly 140 includes a bell 142 and a tray 144. The tray 144 may be used as an outer assembly for a funereal tray. Alternatively, a mattress may be disposed directly into the tray 144. The bell 142 includes an outwardly and downwardly extending lip 146 that is designed to fit with the lip 148 of the tray 144. A gasket 150 is disposed between the lip 146 and the lip 148 to provide an airtight seal. The bell 142 and tray 144 in this embodiment are made of 0.25 inch styrene, although other materials may be used.

The burial bell assembly 140 may be modified in a number of ways. For example, if it is desired to pressurize the inner chamber of the burial bell assembly 140, fasteners may be used to maintain the bell 142 and the tray 144 in airtight relationship. Additionally, a valve assembly may be included allowing gases to be withdrawn from or inserted into the inner chamber. Alternatively, the tray 144 and the bell 142 may be directly sealed to each other using an adhesive or sealant. Depending on the materials used, the bell and the tray may alternatively be welded to each other. Moreover, the bell 142 and/or the tray 144 may be designed to be nestable with other bells and/or trays to reduce shipping volume. This can be easily accomplished, for example, by flaring the sides of the bell 142 from the top of the bell 142 to the lip 146.

Figure 18:
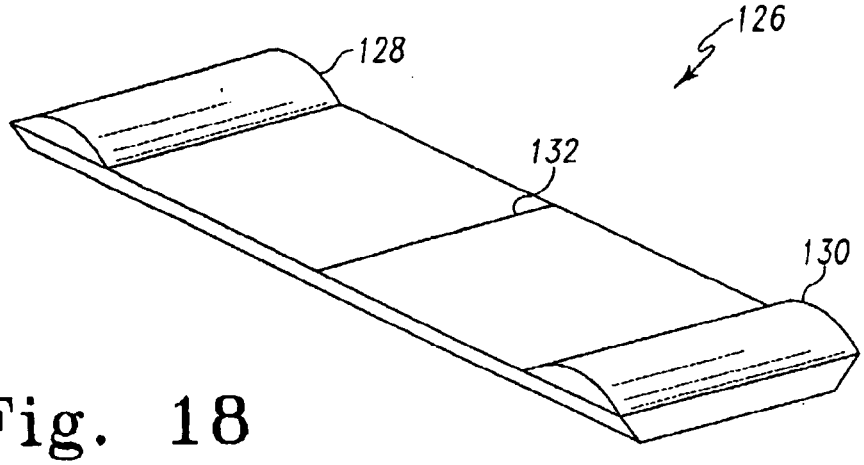
FIG. 18 shows a perspective view of an alternative embodiment of an inner tray assembly that incorporates features of the present invention.

It will be appreciated that the above embodiments are merely exemplary, and that those of ordinary skill in the art may readily devise their own implementations and adaptations that incorporate the principles of the present invention and fall within the spirit and scope thereof. By way of example, but not of limitation, the tray 26 may be modified to be reversible. Such a modification is shown in FIG. 18, where an inner assembly 126 includes pillow 128 and pillow 130. The material used to cover the pillows and bedding associated with the pillows is of two separate colors and/or patterns that are joined together at seam 132. Thus, a single inner assembly provides an option of two colors and/or patterns for a particular funeral.

Figure 19:
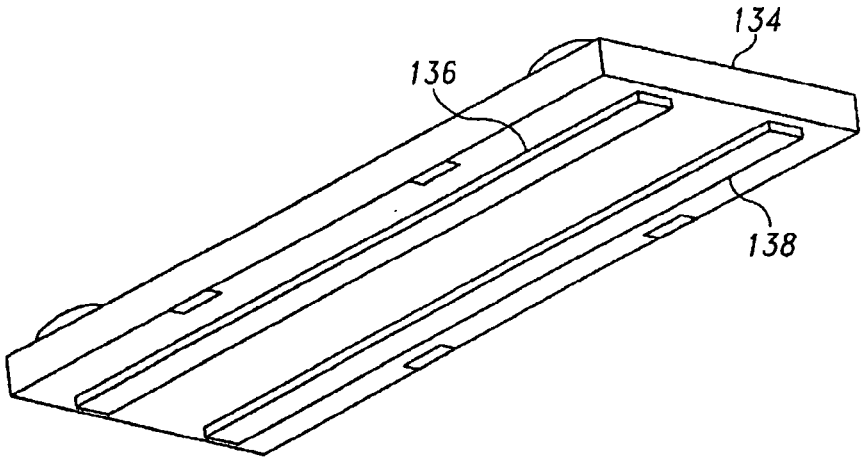
FIG. 19 shows a perspective view of an alternative embodiment of an outer tray assembly with support skids in accordance with features of the present invention.

Additionally, the support and frictional characteristics of the tray may be provided in accordance with a number of design choices. By way of example, but not of limitation, the outer assembly 134 shown in FIG. 19 includes two support skids 136 and 138 of low friction material. Thus, some structural support is provided as well as a surface conducive to sliding into and out of a casket is provided.

Moreover, many detailed features have been disclosed herein that provide additional advantages beyond those of the present invention, or indeed enhance the present invention. It will be appreciated that many of the advantages of the present invention may be obtained without such detailed features. Accordingly, the claims defined below are not intended to incorporate portions or details of the disclosed embodiments that are not expressly recited in the claims. The principles of the present invention have widespread applications, and may be incorporated into any number of burial bell and tray designs by those of ordinary skill in the art.

We claim:

1. A rental casket system comprising:

a container sized to receive remains of a deceased, the container having at least one moveable vertical wall configured to provide an opening to an interior of the container;

a tray sized to fit within the container, the tray containing a bottom surface and an outer wall that extends upwardly from proximate the periphery of the bottom surface; and a lid configured to form a hollow interior and sized to engage the tray, the hollow interior having a height that is greater than the height of the wall of the tray, wherein the tray bottom surface comprises a first and a second end portion and a first and a second side portion, and wherein the outer wall of the tray comprises a first and a second end wall that extend upwardly from the first and second end portions of the bottom surface, respectively, and a first and a second side wall that extend upwardly from the first and second side portions of the bottom surface, respectively, each of the first and second end walls movably attached to each of the first and second side walls by a tie wrap.

2. The rental casket system of claim 1, wherein:

the first and the second end wall extend upwardly about 2–4 inches from the first and second end portions of the bottom surface.

3. The rental casket system of claim 1, wherein the tray and the lid are constructed of a combustible material suitable for cremation.

4. The rental casket system of claim 1, wherein the lid includes a first lid segment and a second lid segment.

5. The rental casket system of claim 1, wherein the tray and the lid cooperate to form a burial structure.

6. The rental casket system of claim 5 wherein the lid is constructed of a ¼" thick styrene.

7. The rental casket system of claim 1, further comprising:

a water-proof sheet sized to lay along the bottom surface of the tray and to extend upwardly within the outer wall; and an inner shell sized to fit within the first and second end wall and the first and second side wall.

8. The rental casket system of claim 7, wherein:

the tray comprises a handhold proximate an outer portion of the tray; and a portion of the inner shell is located above the handhold such that the portion of the inner shell is disposed between a handhold opening and a proximate portion of the water-proof sheet.

9. The rental casket system of claim 1, wherein the at least one movable vertical wall comprises a removable end portion, wherein when the removable end portion is installed, the removable end portion must be moved in a first direction and then a second direction in order to be removed from the container.

10. The rental casket system of claim 9, wherein the container further comprises:

a first and a second container side wall, each of the first and the second container side walls having a groove formed therein that extends upwardly from a bottom portion of the side wall and expands laterally from the bottom portion to the top portion, the groove configured to receive an edge of the removable end portion; and a top that extends at least partially over the grooves in the first and second side walls such that when the removable end portion is installed, the removable end portion cannot be removed by lifting the end portion directly in an upward direction.

11. The rental casket system of claim 1, wherein the tray comprises:

an end handhold proximate the first end portion, such that when the removable end portion of the container is removed, and the tray is installed in the container, the end handhold is accessible through the end of the container from which the removable end portion was removed.

12. The rental casket system of claim 1, wherein the tray comprises polypropylene.

13. A rental casket system comprising:

a container sized to receive remains of a deceased, the container having at least one moveable vertical wall configured to provide an opening to an interior of the container;

a tray sized to fit within the container, the tray containing a bottom surface and an outer wall that extends upwardly from proximate the periphery of the bottom surface;

a lid configured to form a hollow interior and sized to engage the tray, the hollow interior having a height that is greater than the height of the wall of the tray;

a water-proof sheet sized to lay along the bottom surface of the tray and to extend upwardly within the outer wall, the outer wall including first and second end walls and first and second side walls;

an inner shell sized to fit within the first and second end wall and the first and second side wall; and a mattress sized to lie within an area defined by the first and second end walls and the first and second side walls.

14. The rental casket system of claim 13, wherein the water-proof sheet lies at least partially within the inner shell and the mattress is at least partially on top of the water-proof sheet.

15. The rental casket system of claim 14, wherein:

the tray comprises a handhold proximate an the outer portion of the tray; and a portion of the inner shell is located above the handhold such that the portion of the inner shell is disposed between a handhold opening and a proximate portion of the water-proof sheet.

16. The rental casket system of claim 13, further comprising a pillow, wherein:

the mattress has an end portion and is sized to be shorter than the length of the tray, such that when the mattress and pillow are assembled with the tray, the mattress defines one end of a cavity into which the pillow of another assembled tray may be placed such that the tray is nestable with the other assembled tray.

17. The rental casket system of claim 16, further comprising a plurality of slip covers, each of the plurality of slip covers sized to fit over the inner shell.

18. The rental casket system of claim 13, wherein the at least one movable vertical wall comprises a removable end portion, wherein when the removable end portion is installed, the removable end portion must be moved in a first direction and then a second direction in order to be removed from the container.

19. The rental casket system of claim 18, wherein the container further comprises:

a first and a second container side wall, each of the first and the second container side wall having a groove formed therein that extends upwardly from a bottom portion of the side wall and expands laterally from the bottom portion to the top portion, the groove configured to receive an edge of the removable end portion; and a top that extends at least partially over the grooves in the first and second side walls such that when the removable end portion is installed, the removable end portion cannot be removed by lifting the end portion directly in an upward direction.

20. The rental casket system of claim 18, wherein the tray comprises:

a first end portion; and an end handhold proximate the first end portion, such that when the removable end portion of the container is removed, and the tray is installed in the container, the end handhold is accessible through the end of the container from which the removable end portion was removed.

21. The rental casket system of claim 13, wherein the tray further comprises:

a first and a second side portion;

a first plurality of handholds located proximate to the first side portion; and a second plurality of handholds located proximate to the second side portion.

22. The rental casket system of claim 13, wherein the tray comprises polypropylene.

23. The rental casket system of claim 22, wherein the lid and the tray cooperate to form a burial container.

24. The rental casket system of claim 13, wherein the lid and the tray are constructed of a combustible material suitable for cremation.

25. The rental casket system of claim 13, wherein the lid is constructed of a ¼" thick styrene.

* * * * *